US006202398B1

(12) United States Patent
Dinkelmann et al.

(10) Patent No.: US 6,202,398 B1
(45) **Date of Patent: *Mar. 20, 2001**

(54) METHOD OF AND APPARATUS FOR PRODUCING A YARN ON A POT-SPINNING MACHINE

(75) Inventors: Friedrich Dinkelmann, Rechberghausen; Andreas Olbrich, Kirchheim, both of (DE)

(73) Assignee: Zinser Textilmaschinen GmbH, Ebersbach/Fils (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/285,586

(22) Filed: Apr. 2, 1999

(30) Foreign Application Priority Data

Apr. 3, 1998 (DE) ..... 198 15 049

(51) Int. Cl.[7] ..... D01H 5/785

(52) U.S. Cl. ..... 57/76; 57/315; 19/246; 19/266; 19/288

(58) Field of Search ..... 57/76, 75, 315, 57/328; 19/288, 244, 246

(56) References Cited

U.S. PATENT DOCUMENTS

| | | | | |
|---|---|---|---|---|
| 5,651,244 | * | 7/1997 | Lucca et al. | 57/75 |
| 5,915,510 | * | 6/1999 | Dinkelmann | 19/288 |
| 6,029,318 | * | 2/2000 | Dinkelmann | 19/244 |
| 6,032,451 | * | 3/2000 | Dinkelmann | 57/315 |

FOREIGN PATENT DOCUMENTS

| | | |
|---|---|---|
| 882 066 | 7/1953 | (DE) . |
| 41 39 067 | 6/1993 | (DE) . |
| 44 26 249 | 2/1996 | (DE) . |
| 195 48 670 | 6/1997 | (DE) . |
| 0 635 590 | 1/1995 | (EP) . |

* cited by examiner

*Primary Examiner*—John J. Calvert
*Assistant Examiner*—Shaun Hurley
(74) *Attorney, Agent, or Firm*—Herbert Dubno

(57) ABSTRACT

A yarn is made on a pot-spinning machine by drafting a roving and then condensing the roving via a suction roller or belt before the yarn is twisted on a pot-spinning station.

10 Claims, 6 Drawing Sheets

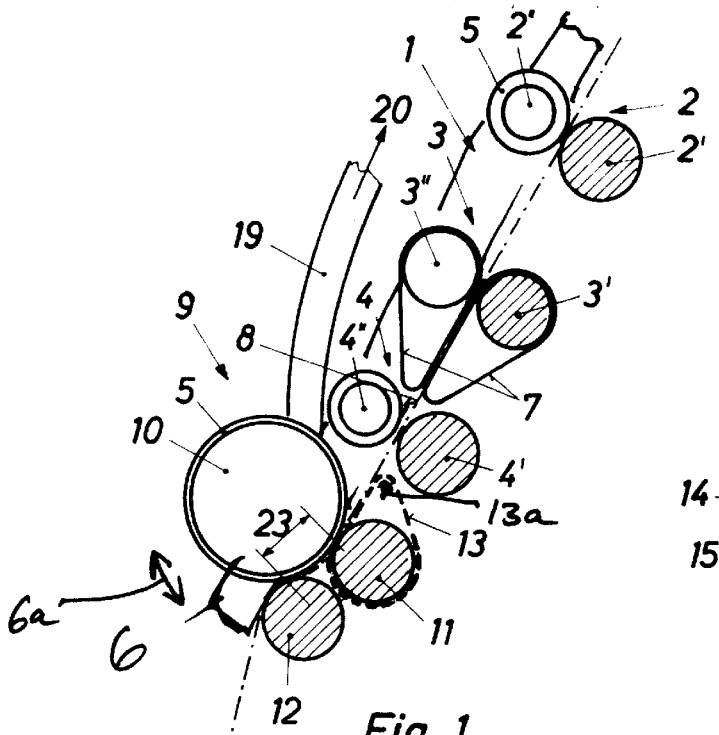
Fig. 1
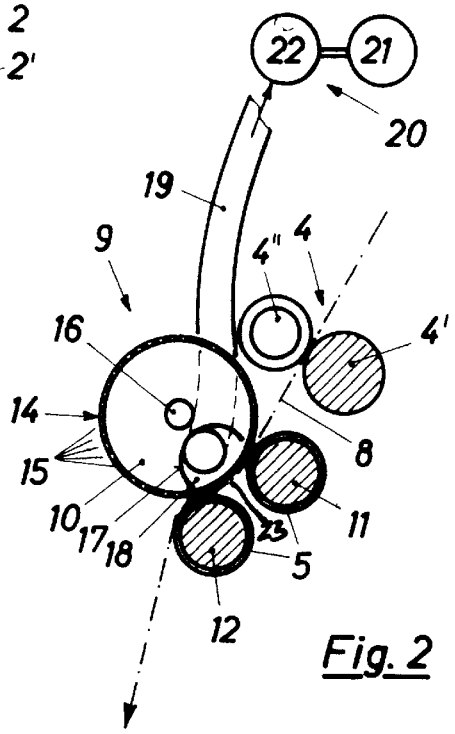
Fig. 2
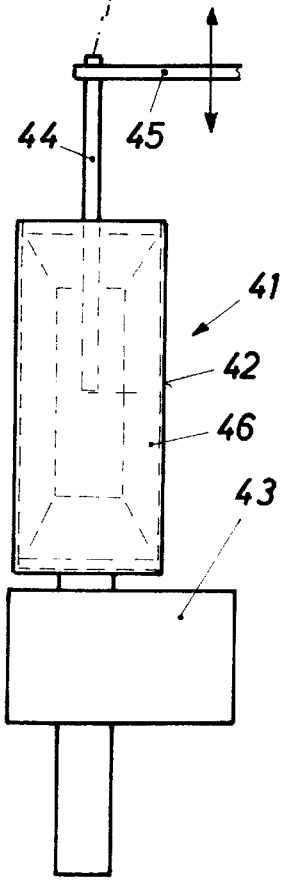
Fig. 3
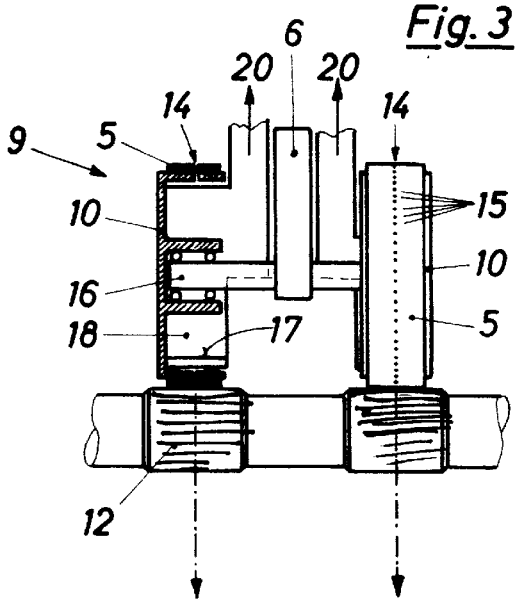

Fig. 6
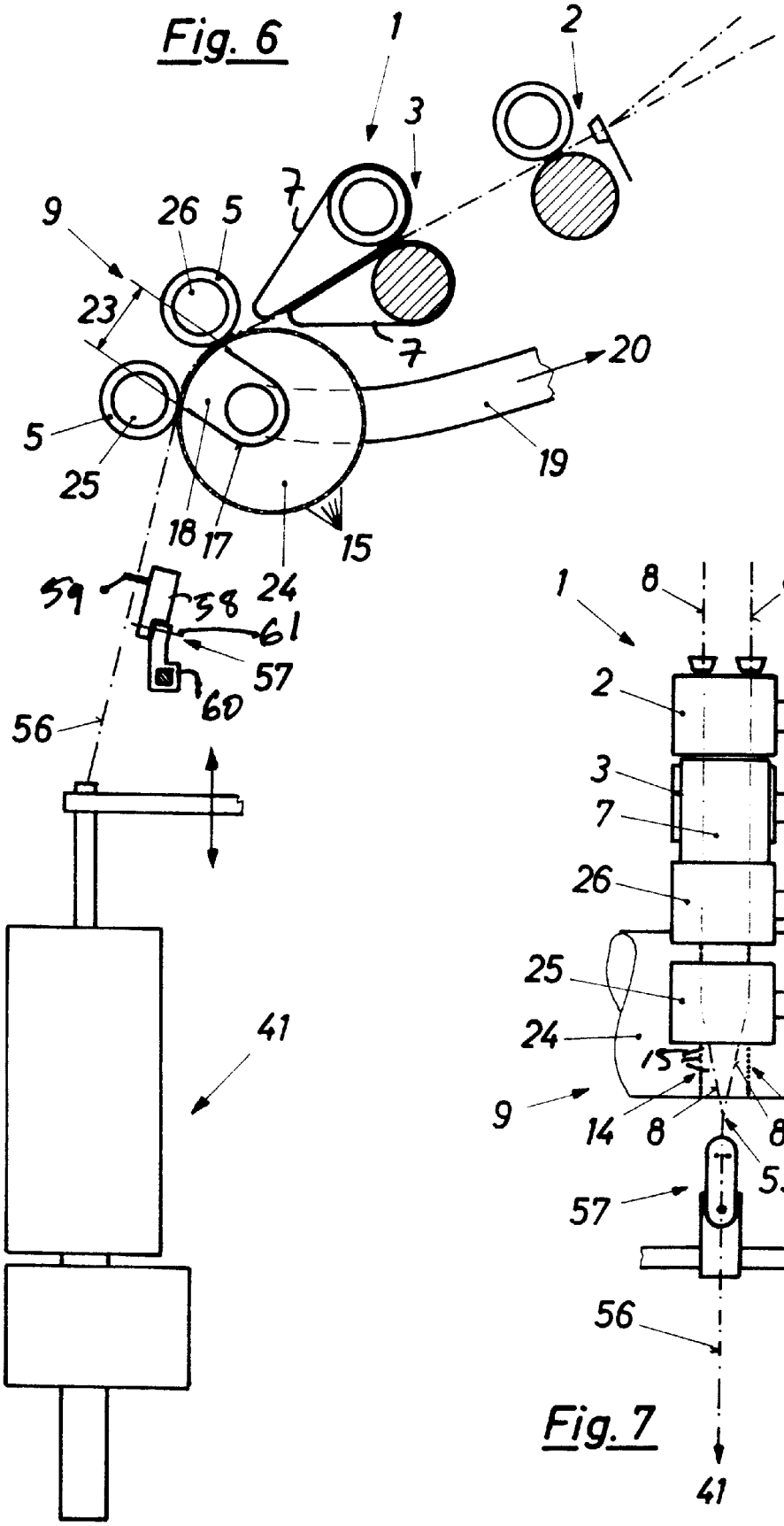
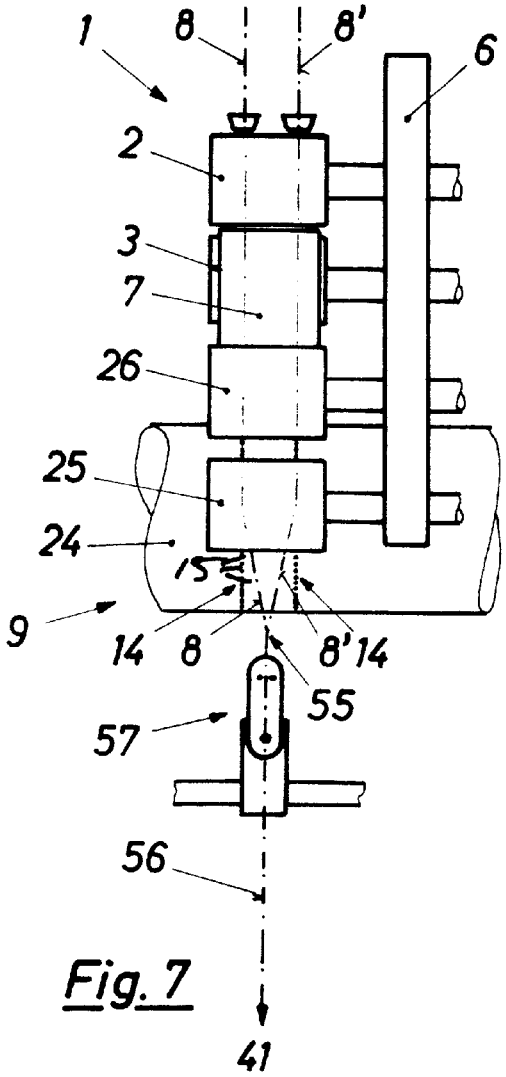
Fig. 7

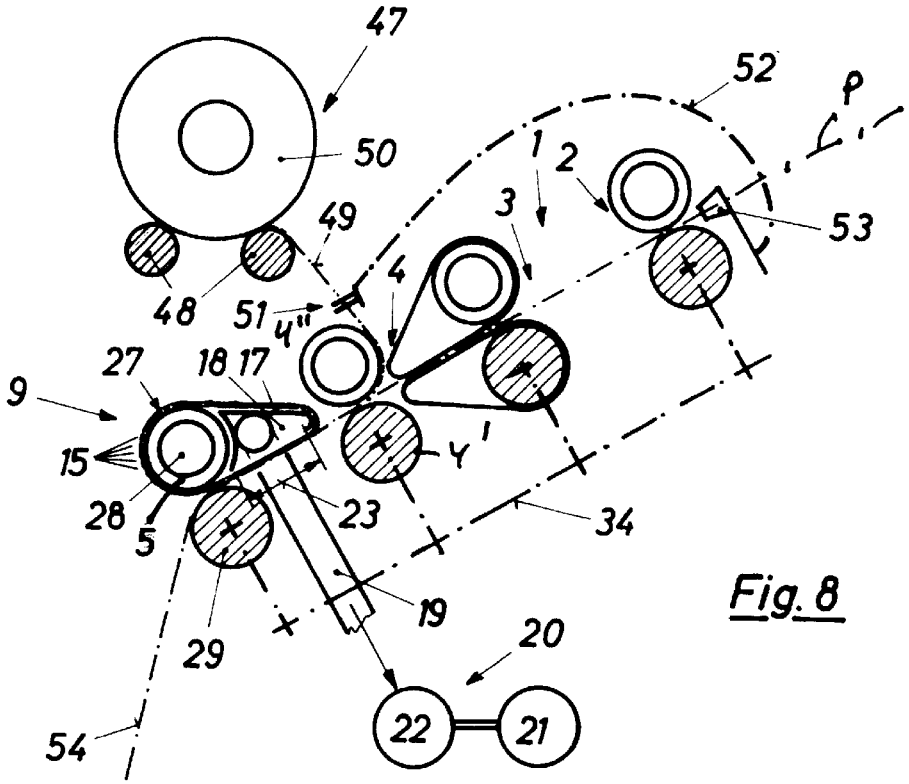
Fig. 8
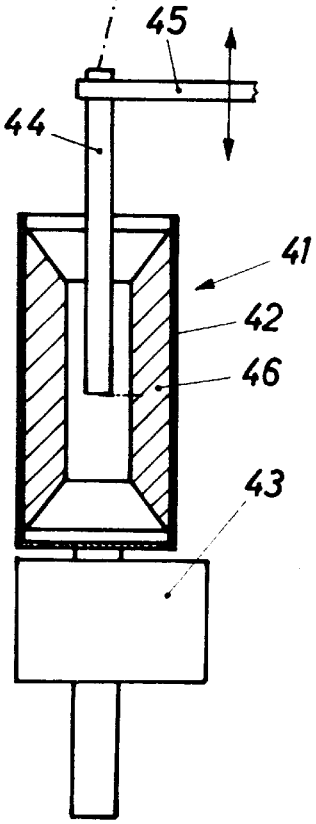
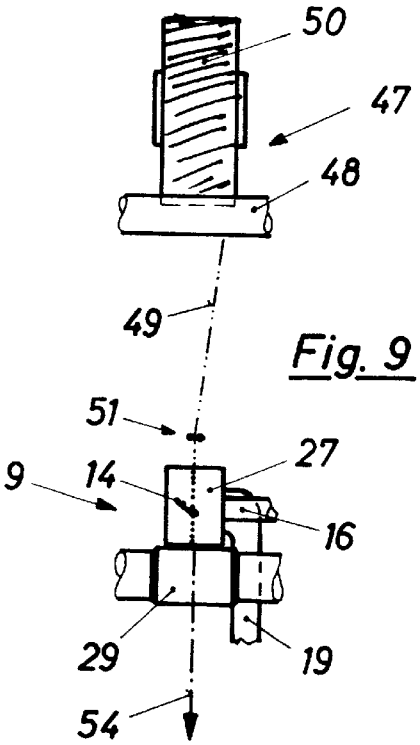
Fig. 9

METHOD OF AND APPARATUS FOR PRODUCING A YARN ON A POT-SPINNING MACHINE

FIELD OF THE INVENTION

Our present invention relates to a method of and to an apparatus for the production of yarn. More particularly, the invention relates to a method producing a yarn in which roving supplied by a drafting frame is subjected to condensing (compaction) and is then twisted and collected at a spinning station of the spinning machine. The invention also relates to the spinning machine which is used for that purpose.

BACKGROUND OF THE INVENTION

A spinning machine generally comprises a drafting frame and a multiplicity of spinning stations, the drafting frame comprising a number of roller pairs through which the roving passes for drafting or drawing between the roller pairs which can be operated at successively higher peripheral speeds. The lower rollers of the roller pairs may be continuous, i.e. rollers that extend the full length of the drafting frame, while the upper rollers or pressing rollers may be mounted in the weighting or loading arm and can be specific to the particular spinning station. Twinned upper rollers are commonly also provided, i.e. each arm may press two upper rollers against one of the continuous lower rollers.

At each spinning station the roving or, where two or more rovings are supplied to a given station, the plurality of rovings thus supplied are twisted and wound up in a yarn body.

The condensing or compacting system for a roving or slubbing can be provided as described in German patent document DE 44 26 249 A1 or EP 0 635 590 A2. In the first case, the condensing device is in the form of a rotatable cylindrical roller which is provided along its periphery with a row of perforations. The perforations can be maintained under suction and the roller can be referred to as a suction roller. In the EP 0 635 590 A2 publication, the row of perforations is provided on an endless flexible belt and suction can be applied to these perforations as well.

The condensing or compaction operation applies a roving delivered by a drafting frame, has the advantage of drawing the roving together so that when it enters the twisting zone it is substantially more compact than when, as sliver or slubbing, it arrives at the drafting frame. Since the roving before it reaches the twisting zone is more tightly defined by reason of the condensing or compaction steps, the twist tends to jump practically to the nip of the last roller pair in the path of the yarn before the spinning station and the so-called "spinning triangle" can be relatively small. Losses of edge fibers from the yarn can be minimal and the number of fibers which project out of the yarn can be small as well so that the finished yarn has a low degree of hairiness.

OBJECTS OF THE INVENTION

It is the principal object of the present invention to provide an improved method of making yarn of low hairiness and high quality, whereby drawbacks of earlier systems are avoided.

Another object of the invention is to provide a method of producing yarn in which fiber losses during the yarn spinning process are held to a minimum.

It is still another object of the invention to provide an improved spinning machine for the purposes described.

SUMMARY OF THE INVENTION

We have now found that all of these objects can be obtained and yarn of improved quality can be produced when, after drafting of the roving or slubbing, the latter is subjected to a condensing operation as described and the resulting compacted roving is then twisted and collected in a yarn body utilizing a pot-spinning machine. In other words, by providing the condensing device on the spinning machine immediately downstream of the drafting frame or as an integral part of the drafting frame immediately after the last roller pair thereof, we can take advantage of the reduction in peripheral fiber loss and the reduced hairiness of the product.

It has been found further that when, in conjunction with the condensing action, the twisting and winding up of the yarn is carried out on a pot-spinning machine, additional advantages can be obtained. The twisting and winding up of the yarn can be carried out on such a pot-spinning apparatus in a balloonless manner and with reduced yarn tension in the piece of yarn between the point at which the yarn is deposited in the yarn cake in the spinning head and the output roller pair of the drafting frame by comparison with the yarn tension in a ring-spinning machine or the like. This effect of the pot-spinning machine is in addition to or in support of the effect of the compaction of the roving.

According to a feature of the invention the condensing or compaction operation is carried out before twisting is imparted to the roving. According to a feature of the invention the spinning machine can comprise:

- a drafting frame for drafting roving to produce drafted roving;
- a condensing device downstream of the drafting frame for compacting the roving to compacted roving;
- a pot-spinning station receiving at least one of the compacted rovings for balloonless twisting thereof to form a yarn and for collecting yarn in a yarn body.

In this pot-spinning machine, the condensing device can be provided on the drafting frame. The condensing device can be provided with a suction roller, i.e. a hollow rigid rotating body to which suction is supplied at its center and which is formed with a row of perforations applying suction to the roving. Where necessary or desirable, the suction can be applied through a flexible belt guided over a roller and which can be used to support the roving between the output rollers of the drafting frame and the roller about which the belt passes.

The pot-spinning stations can be of conventional construction for pot-spinning machines.

According to the invention, core yarn can be made utilizing the principles described above and mock yarn can be fabricated as well. Reference may be had to our commonly assigned copending application, Ser. No. 09/285,434 filed concurrently herewith and based upon German application 198 15 053.9 filed Apr. 3, 1998.

For the fabrication of a core yarn, core threads should be as much as possible wholly embedded in the roving and the roving should be twisted so that the core yarn is not at all visible in the roving. In conventional core yarn spinning, there are gaps in the cover fibers through which the core yarn or thread may be visible or over which the application of the cover filaments may be incomplete, thereby leading to a reduction in the quality of the resulting core yarn. When a core thread is, in accordance with the invention, embedded in the roving prior to the condensing or compaction step, it has been found that the coverage of the core thread is far more complete and hence the yarn is of higher quality.

Indeed, it has been found to be advantageous in this case to feed the core thread to the roving upstream of the condensing or compaction zone and where the roving is still relatively wide as much as possible centrally to the roving. This is especially the case where the core thread is supplied to the roving upstream of the output pair of rollers of the drafting frame. Of course, as an alternative, the core thread can also be fed directly to the condensing or compaction zone. It has been found to be advantageous to feed the core thread to a perforated belt extending from the last roller pair of the drafting frame as part of the condensing or compaction unit and to supply core thread from above or below so that it is delivered to the belt at the point at which the belt undergoes a change in direction proximal to the nip of the last roller pair of the drafting frame.

Alternatively, the belt can be provided at its inlet side with a guide roller so that the core thread is fed between this guide roller and the belt. When the condensing device has a suction roller, the core thread can also be fed to the periphery of the suction roller so that it can be held by suction thereagainst. The core thread also can be delivered to the nip of the last roller pair of the drafting frame.

While each roving can receive a single core thread, it is also possible to supply a plurality of core threads to the roving and thereby form a core yarn when the roving is twisted. Two or more rovings each provided with one or more core threads can be collected before the twist is imparted and the yarn formed so that, by imparting the rotation, a so-called "mock" yarn with two core threads can be produced.

The term "mock yarn" is here used in the sense described in the earlier application to refer to a yarn in which the two rovings or slubbings which are joined have little or no twist prior to being united into a mock yarn and then twisted together so that the rovings are intertwined. In true yarn, by contrast, the elements which are twisted together are previously twisted themselves so that they can be distinguished in the spun yarn. In the mock yarn to which reference is made here, the individual rovings have no intrinsic twist although they are twisted together as is the case with a true yarn.

A mock yarn is similar in appearance to the true yarn to the extent that the two components of the mock yarn are individually recognizable. The condensing or compaction step of the present invention assists in enabling the two rovings to be distinguished from one another in the yarn so that the mock yarn more closely resembles a true yarn than has been the case heretofore with such mock yarns. The two rovings, because of the compaction, remain clearly separated from one another.

BRIEF DESCRIPTION OF THE DRAWING

The above and other objects, features, and advantages will become more readily apparent from the following description, reference being made to the accompanying drawing in which:

FIG. 1 is a transverse section through a spinning machine according to the invention, in highly diagrammatic form, showing the combination of the drafting rollers, the condensing or compacting unit and the pot-spinning station;

FIG. 2 is a detail showing a modification of the condensing or compaction unit of FIG. 1;

FIG. 3 is a front view, partially broken away, with a portion of the condensing unit of FIGS. 1 and 2;

FIG. 4 is a view similar to FIG. 1 showing another embodiment of the apparatus;

FIG. 6 is another view similar to FIG. 1 illustrating still another embodiment of the invention;

FIG. 7 is a diagrammatic and fragmentary front view of a portion of the apparatus of FIG. 6;

FIG. 8 is still another view similar to FIG. 1 illustrating the invention as represented by another embodiment for producing a core yarn;

FIG. 9 is a simplified front view of a portion of the apparatus of FIG. 8;

SPECIFIC DESCRIPTION

Figure 5:
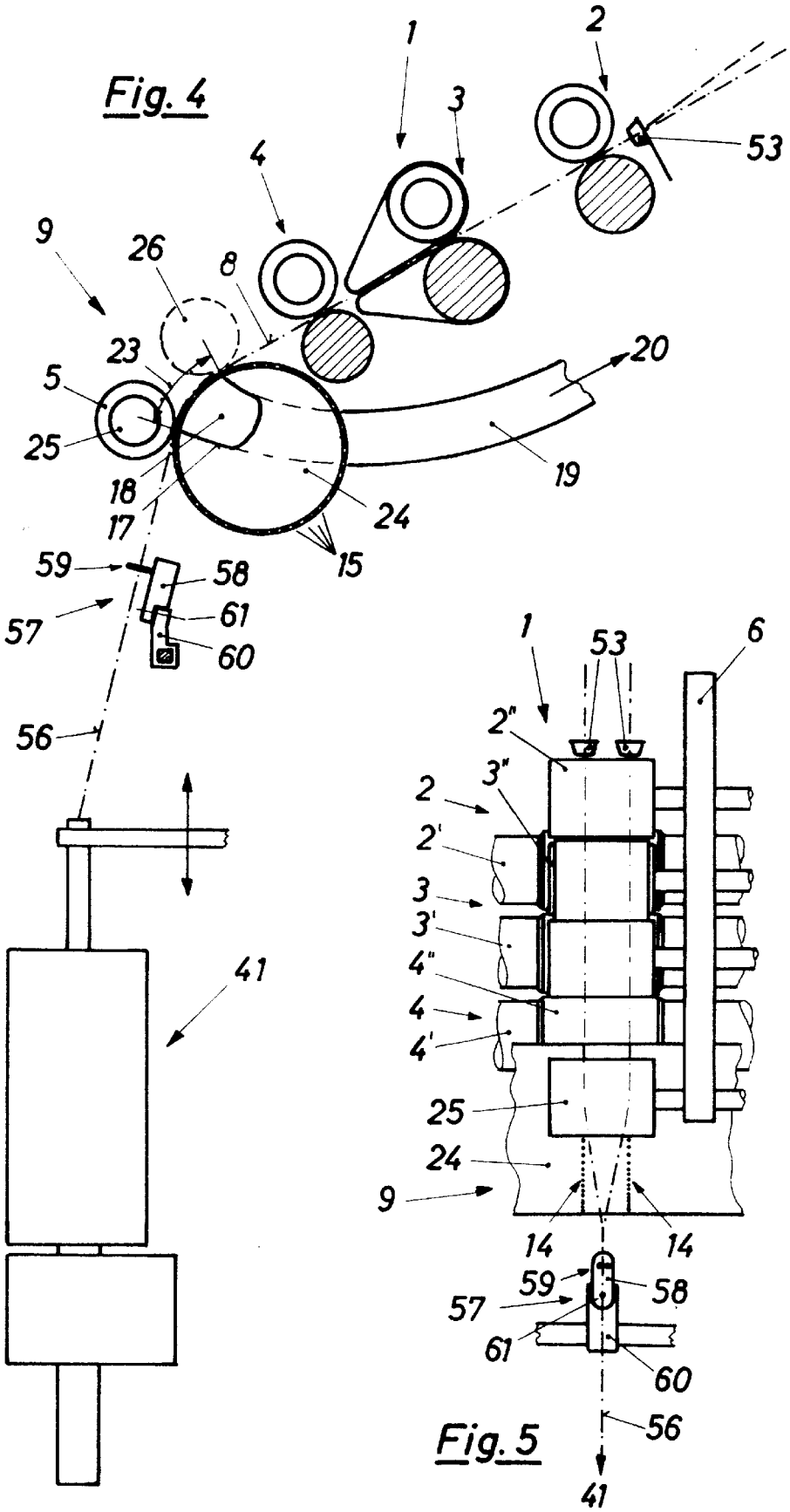
FIG. 5 is a front view of the condensing or compaction system of FIG. 4, likewise in highly diagrammatic form and partially broken away.

A spinning machine according to the invention can comprise, as has been illustrated in FIG. 1, a drafting frame 1 of conventional construction with an input roller pair 2, an intermediate roller pair 3 and an output roller pair 4. The lower rollers 2', 3' and 4' of these roller pairs are steel rollers which extend over the entire length of the drafting frame and hence over the entire length of the side of the spinning machine which can be provided with a large number of spinning stations spaced therealong. In the regions of the spinning stations, the lower rollers are milled or knurled as has been shown in roller 12 in FIG. 3. The upper rollers 2", 3" and 4" of these pairs of rollers can be provided as twin rollers, like the twin suction rollers in FIG. 3 and the upper rollers 2" and 4" can be provided with elastic jackets 5. The rollers are mounted on a weighting arm 6 via appropriate pivots and bearing arrangements allowing a certain play as is conventional and the arm 6 can be swingable in the direction of the arrow 6*a* (FIG. 1) to allow access to the roving path between the rollers of the pairs and to enable the rollers 2", 3" and 4" to press with the weight of the arm 6 against the rovings and the fixed lower rollers. Spring loading can also be provided for the arm 6.

The rollers 3' and 3" of the intermediate roller pair 3 can be equipped with belts 7 mounted on the arm 6 or the support structure of the drafting frame and guided in belt cages as may be desired. The drafting frame 1 supplies at least one roving 8 to each twisting station with the desired drafted fineness but without stabilization by twisting or spinning.

Of course other kinds of drafting frames can be used and the drafting frames may employ a variety of condensing or compacting units 9 which can be mounted on the drafting frame downstream of the final pair 4 of the drafting rollers.

In the embodiments of FIGS. 1–3, the condensing unit or device 9 can comprise an upper suction roller which is located above the path of the roving 8 and hence above the stretching field plane of the drafting frame. The upper suction roller 10 can rest upon two lower rollers 11 and 12 which may extend the full length of the stretching frame and can be steel rollers as are the rollers 2', 3' and 4'.

To prevent the roving upon a roving breakage or as a result of shut down of the drafting frame, from dropping out of the stretching field plane, a gap between the output roller pair 4 of the drafting frame and the nip between the lower roller 12 and the suction roller 10 can be bridged by a transport belt. The latter can be guided by any conventional means for example a guide bar 13*a*. The belt has been represented at 13 in FIG. 1 and extends practically to the nip between the rollers 4' and 4", i.e. the line along which the roving is clamped by the rollers of the output pair of the drafting frame. The belt 13 serves to support the roving against the effects of spurious air streams which might otherwise deflect the roving where it is unsupported. The belt 13 supports the roving and prevents tearing thereof. The sectional views 2 and 3, taken into mutually perpendicular directions, show the configuration of the suction roller 10. The suction roller 10 is cup-shaped, and is formed along its periphery with perforations 14 in a single line or in two lines or rows (FIG. 3), the perforations being small suction orifices communicating between the interior and exterior of the suction rollers.

The suction rollers 10 are provided in pairs on the arm 6 and have their hubs journaled on pins or axles 16. The suction chambers 18 are defined by shields 17 with the inner peripheries of the suction rollers along a stretch between the lower rollers 11 and 12 and the chambers 18 are evacuated through suction pipes 19 connected to a suction source 20 in the form of a suction pump 22 driven by a motor 21. The suction chamber 18 subtends a condensing zone 23 along which the suction roller 10 engages the roving. The length of this suction zone 23 depends upon the length of the fibers to be compacted (staple length) and in the case of cotton, as a rule, is not less than about 15 mm.

The suction roller 10 is usually comprised of steel. To avoid metallic contact between the wall of the suction roller 10 and the lower rollers 11 and 12 which generally also are composed of steel and thereby prevent noise and sliding frictional wear, either the suction roller 10 or the lower roller 11 and 12 or both can be provided with elastic jackets 5. In the embodiments of FIGS. 1 and 3, the suction roller 10 is provided with the elastic jacket whereas in the embodiment of FIG. 2, the lower rollers 11 and 12 have elastic jackets 5.

FIGS. 4 and 5 show an embodiment in which a suction roller 24, otherwise corresponding to the suction roller 10 of FIGS. 1–3, can be provided below the path of the roving 8, i.e. below the drafting plane. The suction roller 24 is here juxtaposed with an upper roller 25 which serves as a twist stop for the twist imparted by the subsequent spinning station to the yarn. A suction chamber 18 is also provided within the suction roller 24 and delimits the condensing zone 23. At the upstream end of the condensing zone a further upper roller 26 can be provided.

FIGS. 6 and 7 show a variant of the apparatus of FIGS. 4 and 5 in which a separate output pair of rollers of the drafting frame is eliminated. The function of the output roller pair 4 (FIGS. 4 and 5) of the drafting frame is then assumed by the suction roller 24 and an upper roller 26 juxtaposed therewith and forming a nip receiving the rovings from the intermediate roller pair 3 and the belts 7 thereof.

In the embodiment of FIGS. 8 and 9, the condensing device 9 comprises a suction belt 27 which is looped around an upper roller 28 the latter being formed with an elastic jacket 5.

The suction belt 27 is formed centrally of its periphery with a row of perforations 14. Within the suction belt 27, the suction chamber 18 is provided over a condensing zone 23 and is delimited by the shield 17. Suction is applied to the chamber 18 through the suction pipe 19 via the suction source 20 with its pump 22 and motor 21. In the suction zone 23, suction is applied through the belt 27 to the rovings passing below it and over the lower rollers 4' and 29. The lower roller 29 is juxtaposed with the upper roller 28 about which the belt 27 is looped and which lies above the plane P of the drafting frame, also referred to as the stretching field plane.

Figure 10:
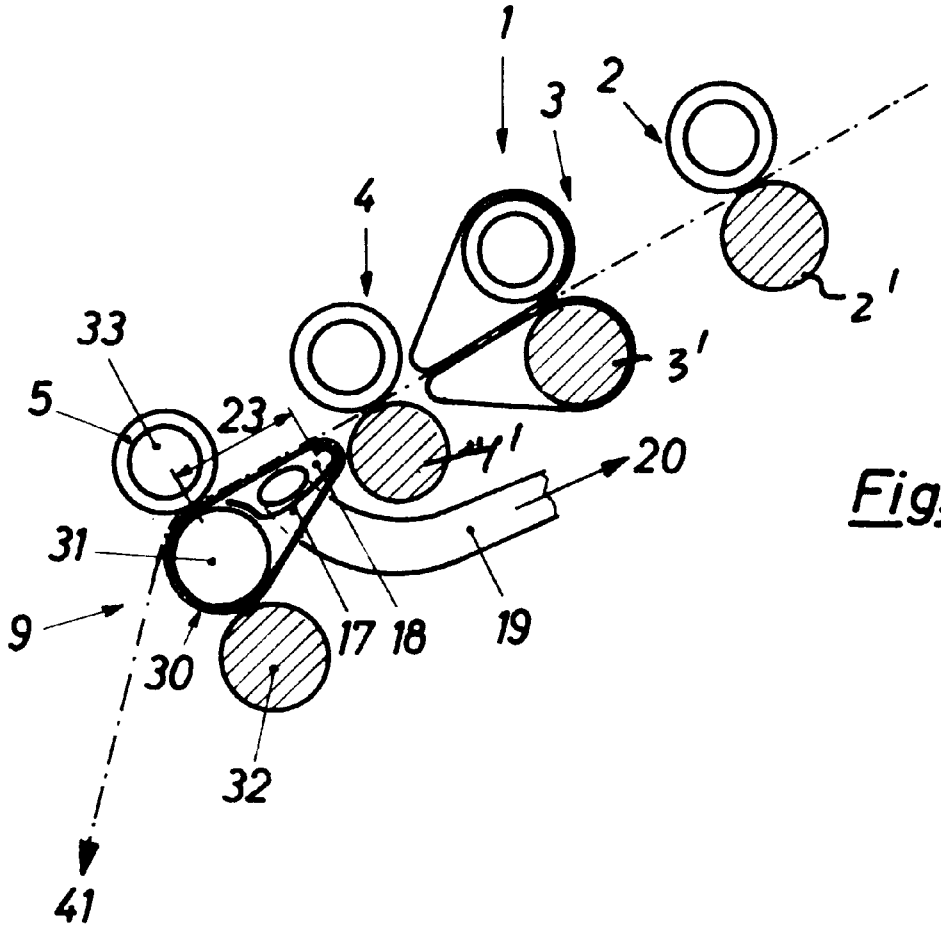
FIG. 10 is a transverse section through a drafting frame representing a modification of the drafting frames of the earlier Figures.

In the embodiment of FIG. 10, the condensing device 9 also comprises a suction belt 30 of elastic synthetic resin and which is comparable to the suction belt of the embodiment of FIG. 8 but which is looped around a lower roller 31. The lower roller 31 and the belt 30 press against a lower drive roller 32 which, like the steel rollers 2', 3' and 4', can extend the full length of the drafting frame and serves to drive the belt rollers 31 of all of the condensing units spaced along the spinning machine and each of which serves one of the pot-spinning stations.

The belt roller 31 of the suction belt 30 is juxtaposed with an upper roller 33 which presses the roving against the belt 30.

The suction belt 30 is formed with at least one row of perforations 14 as has been described for the belt of FIG. 8. Within the suction belt 30, the shield 17 defines the suction chamber 18 to create the suction zones 23. The suction chamber 18 is evacuated via the pipe 19 and the suction source 20. The lower belt rollers 31 and the upper rollers 33 are twinned rollers as has been described in connection with FIG. 3 and the upper roller 33 can be provided with an elastic jacket 5 pressing against the belt 30 which is composed of an elastic synthetic resin material. The jacket can be applied to a steel roller body and, if desired, the steel surfaces of the rollers can be provided without such jackets. An arrangement of twin lower belt rollers 31 facilitates replacement of the suction belts 30 in the case of wear.

In all of the embodiments illustrated, the condensing suction rollers 24 (FIGS. 4, 5 and 6), suction belts 27 (FIG. 8) and the upper rollers 25, 26; 28 and 33, in addition to the upper rollers 2", 3" and 4" of the drafting frame can be mounted on the arm 6 so as to be swingable upwardly therewith loaded by the arm 6 against the lower roller or belt provided below the travel path of the rovings.

In all embodiments the lower rollers 2', 3' 4' of the drafting frame 1 and the lower rollers 11, 12; 29, 32 and the lower suction rollers 24 of FIGS. 4 and 5 or 6 and 7 and the lower rollers below the travel path can be mounted on the machine support and driven by the usual drafting frame drive represented at 34 in FIG. 8 in dot-dash lines. The drive, of course, can operate the lower rollers at the requisite speeds to effect the drawing operation and, of course, the drive schematically shown at 34 can be replaced by individual drives for the various rollers.

Figure 11:
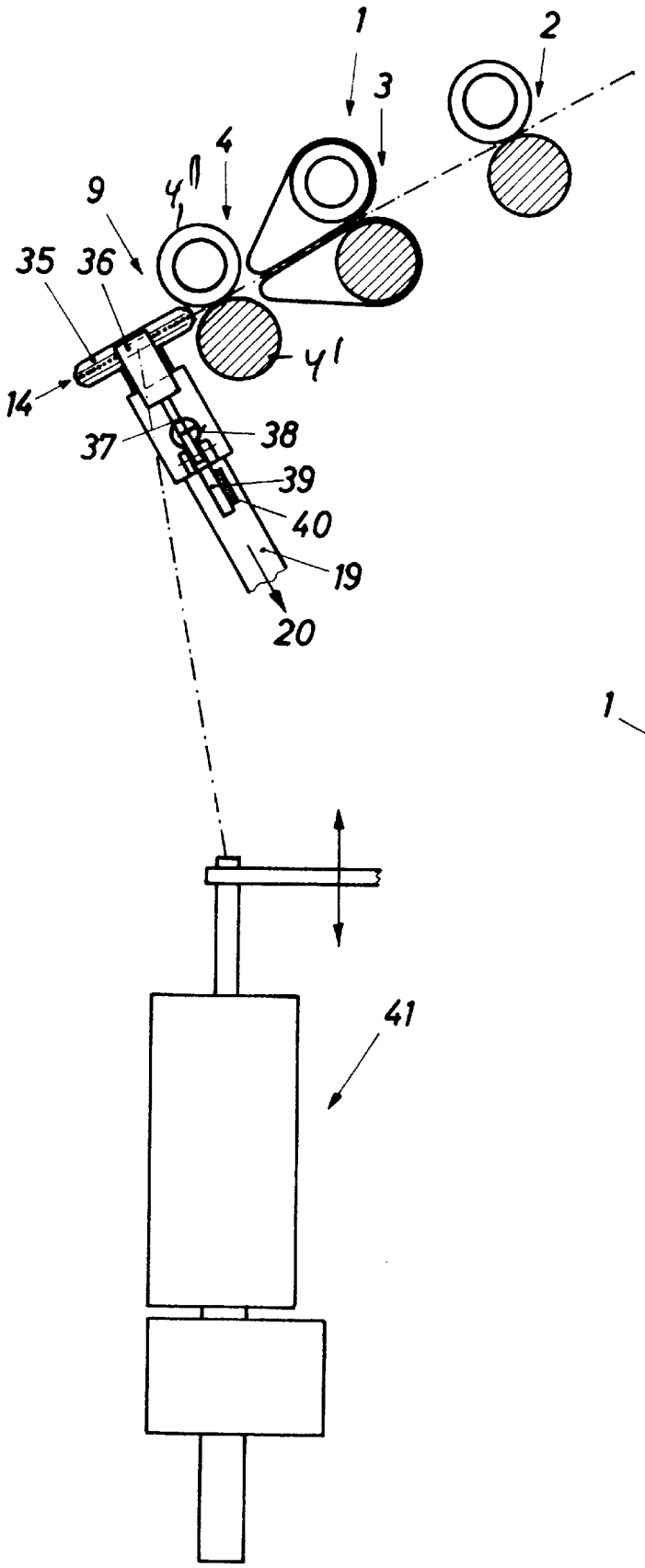
FIG. 11 is a view similar to FIG. 1 of still another embodiment.
Figure 12:
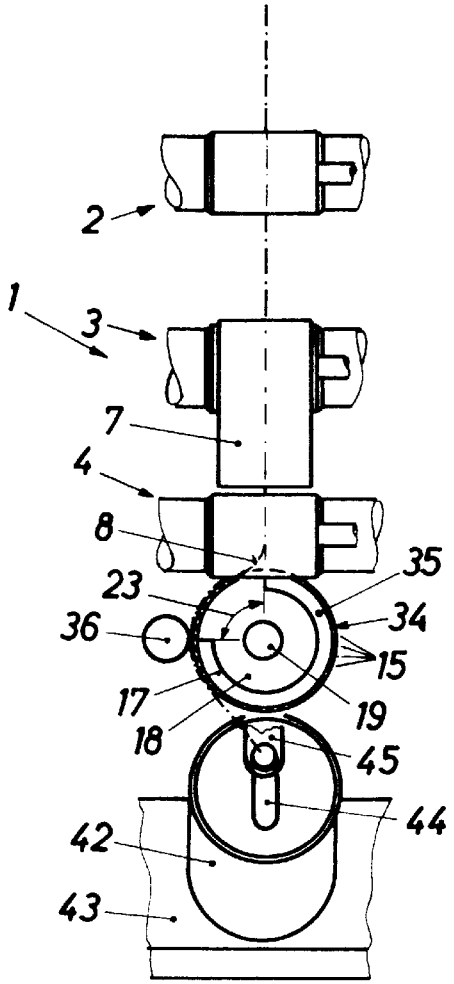
FIG. 12 is a plan view of a portion of the apparatus of FIG. 11.

As can be seen from FIGS. 11 and 12, the condensing device 9 can comprise a disk-shaped suction rotor 35 formed along its periphery with the perforations 14 and so oriented that its perforations lie in a plane to which the contact lies between the rollers of the outlet pair or at the nip engaging the rovings is tangential and in the drafting frame stretch plane. As a result of this disk-shaped configuration and its slender character, the rotor can extend into the crevice between the rollers 4' and 4" of the outlet pair and closely approach the nip between these rollers. The suction rotor 35 in FIG. 12 has been broken away so that the suction pipe 19 can be seen where it opens into the suction rotor and connects to the suction chamber 18 which communicates with the perforations over the condensing zone 23 which represents about a quarter of the circumference of the rotor 35. A pressing roller 36 bears on the periphery of the rotor 35 and is mounted on an arm 37 spring biased by the spring 38 against the rotor periphery. The rotor 35 can itself be driven by a tangential belt 40 engaging the shaft 39 of the rotor 35. The shaft 39 can be hollow to allow the pipe 19 to communicate through this shaft with the suction chamber 18.

Following the condensing unit 9 in each case is a pot25 spinning station 41 of the spinning machine. A multiplicity of these pot-spinning stations 41, each of which has a spinning pot 42, can be spaced along a pot rail 43 which contains the drive and journaling mechanisms for the respective pots. A suitable pot-spinning apparatus can be that described, for example, in U.S. Pat. No. 5,613,355.

A thread guide tube 44 extends into each spinning pot 42 and has its arm 45 connected to a thread-guide rail which has not been illustrated here. The thread-guide tube 44 is thus moved up and down to build the spinning cake 46 in the spinning pot 42 in the conventional manner for such pot-spinning machines and without the formation of a thread balloon. In operation, the drafting frame 1 feeds the roving 8 through the output roller paid 4 to the condensing unit as a strip of a certain width depending upon the diameter of the supplied sliver and the drafting action in the drafting frame. The rovings 8 are compacted by the suction supplied via the suction chamber 18 in the condensing zone 23 which draws fibers extending laterally into line with the perforations. In the compacted state, the roving is supplied to the pot-spinning station 41 and is twisted by the latter to form a stable yarn which is collected in the spinning cake.

In the case of the suction rotor of FIGS. 11 and 12, the invention has the advantage that the rovings can be condensed in its width direction simply by its movement onto the suction rotor. The suction effect then increases the degree of compaction of the roving. When the suction rotor 35 is used, a back and forth movement of the roving is possible without diminishing the compaction effect, since the roving is drawn by the suction at the perforations of the rotor in all of the positions thereof.

The method of the invention can be used not only for making a simple yarn but also for producing core yarns, and/or mock yarn. The apparatus need only then be modified to introduce the core thread or to ensure that two or more previously untwisted but compacted rovings are twisted together. The core yarn will be understood to be a yarn in which an endless (continuous) synthetic thread, referred to as a core thread, is laid into the roving and is enveloped by the fibers thereof over its entire length. The fibers may be cotton fibers and/or wool fibers and the core thread itself may be a twisted or untwisted thread composed of one or more monofilaments.

A mock yarn will be understood to be a yarn which is twisted from two rovings which have themselves not been twisted, i.e. are distinguished by not having been twisted prior to their being rotated about one another in the twist imparted to the yarn by the spinning machine. For the production of the core yarn, the spinning machine can be additionally equipped with a source of the core thread 47 as shown in FIG. 8. In this case, a spool 50 of the core thread can be carried by a pair of feed rollers 48 which supply the core thread 49 via a thread guide 51 to the upstream side of the upper roller 4" of the output roller pair 4 of the drafting frame. The feed rollers 48 can be driven at a peripheral speed less than that of the output roller pair 4 so that a stretch of 2.5 to 5 times can be generated in the core thread.

The core thread 49 is laid into the roving 8 with a speed equal to the speed of the roving in the main drafting region between the roller pairs 3 and 4. The thread guide 51 serves to neutralize the back and forth movement of the core thread 49 as it leaves the spool 50 and to ensure centering of the core thread with the roving which is supplied through the sliver or inlet funnel 53. The coupling between the thread guide 51 and the funnel 53 is represented by the dot-dash line 52. This arrangement ensures that the core thread 49 will always be laid into the roving 8 in the center thereof, and in the condensing zone 23 can be closely surrounded by the fibers of the roving and completely covered thereby in the formation of the core yarn 54.

It will be apparent that the core yarn 49 can also be fed to the roving 8 at the upstream end of the condensing zone 23 and thus between the suction roller 10 or 24 and the lower suction roller 11 or the upper suction roller 26. It can be fed to the belts 27 or 30 at the upstream sides thereof. In the case of rotor 35, the core thread 49 must be fed laterally into the roving.

FIG. 7 shows that the condensing unit of FIG. 6 can be utilized in the formation of a mock yarn. Here two rovings 8 and 8' are drawn in parallel to one another and pass onto the roller 24 which then has two rows 14 of the perforations 15. The two untwisted but separately compacted rovings 8 and 8' are then twisted together in the pot-spinning station 41. The location at which the two rovings join is shown at 55 and the mock yarn is represented at 56. Upon breakage of one of the components of the mock yarn 56, namely, one of the rovings 8 and 8', a yarn breaker 57 is provided (FIGS. 6 and 7) to rupture the remaining strand and prevent the feed of the remaining roving to the yarn cake.

The yarn breaker comprises a catch 58 which is swingable with a pair of pins 59 on a support 60 about an axis 61 such that, when one of the roving components breaks, the catch 58 swings sufficiently so that the remaining roving loops around one of the pins and under the tension at the spinning station 41 is ruptured.

At least one of the mock yarn rovings can have a core thread 49 laid therein so that the product is a core yarn.

The various components described herein for twisting and winding up the yarn, for drafting the same and for condensing or compacting the rovings, for introducing the core thread or for making a mock yarn can be used in any combination.

We claim:

1. A method of producing yarn, comprising the steps of:

drafting roving in a drafting frame to produce a drafted roving;

thereafter compacting the drafted roving in a condensing device to obtain a compacted roving; and pot-spinning the compacted roving to twist the compacted roving and collect the compacted roving balloonlessly into a yarn body.

2. A spinning machine for producing yarn, comprising:

a drafting frame for drafting roving to produce drafted roving;

a condensing device downstream of said drafting frame for compacting said roving to compacted roving;

a pot-spinning station receiving at least one of said compacted rovings for balloonless twisting thereof to form a yarn and for collecting yarn in a yarn body.

3. The spinning machine defined in claim 2 wherein said condensing device comprises a suction roller connected to a suction source and formed along a circumference thereof with a row of perforations, said circumference bearing upon the drafted roving for compacting same.

4. The spinning machine defined in claim 3 wherein said suction roller is disposed above said roving and rests upon at least one driven lower roller.

5. The spinning machine defined in claim 4 wherein said drafting frame has an output pair of rollers and said condensing device comprises a transport belt between said output pair of rollers and said suction roller.

6. The spinning machine defined in claim 5 wherein said transport belt is looped around one of said lower rollers.

7. The spinning machine defined in claim 2 wherein said condensing device comprises a suction belt engaging said roving and having a row of perforations opening toward said roving.

8. The spinning machine defined in claim 2 wherein said condensing device comprises a suction rotor having perforations and engaging said roving between an output pair of rollers of said drafting frame and said pot spinning station.

9. The spinning machine defined in claim 2, further comprising means for feeding a core thread to said roving for envelopment by filaments thereof during twisting, thereby forming a core yarn.

10. The spinning machine defined in claim 2 wherein said condensing device feeds a plurality of untwisted compacted drafted rovings to said pot spinning station for twisting thereby into a mock yarn.

* * * * *